US005820039A

United States Patent [19]

Martin et al.

[11] Patent Number: 5,820,039

[45] Date of Patent: Oct. 13, 1998

[54] METHOD AND APPARATUS FOR DEHULLING MILO

[75] Inventors: Tom Martin, Mesa, Ariz.; Hilbert Schramm, Amarillo, Tex.

[73] Assignee: Biofoam Corporation, Atlanta, Ga.

[21] Appl. No.: 17,835

[22] Filed: Feb. 3, 1998

Related U.S. Application Data

[62] Division of Ser. No. 512,083, Aug. 7, 1995, Pat. No. 5,713,526.

[51] Int. Cl.[6] ..... B02C 19/12

[52] U.S. Cl. ..... 241/7

[58] Field of Search ..... 241/7, 74

[56] References Cited

U.S. PATENT DOCUMENTS

| | | | |
|---|---|---|---|
| 1,987,941 | 1/1935 | Mathews . | |
| 4,052,518 | 10/1977 | Borisov et al. . | |
| 4,148,251 | 4/1979 | Satake . | |
| 4,155,295 | 5/1979 | Satake . | |
| 4,522,837 | 6/1985 | Meinardus . | |
| 5,082,680 | 1/1992 | Tkac . | |
| 5,387,430 | 2/1995 | Tkac . | |
| 5,709,344 | 1/1998 | Archer | 241/7 |

FOREIGN PATENT DOCUMENTS 1258230 12/1971 United Kingdom .

OTHER PUBLICATIONS

Satake Rice Whitening Machine, Cat No. 111–2–(8), Satake Corporation, Features, Specifications, Dimensions and Capacities.

Fasco Scouring Equipment, Features.

*Primary Examiner*—Mark Rosenbaum

*Attorney, Agent, or Firm*—Arnold White & Durkee

[57] ABSTRACT

An apparatus and method for removing hulls from milo berries is provided. The apparatus includes a first cylindrical shaped chamber having a plurality of abrasive grinding stones mounted on a shaft extending through the chamber. The outlet to the first chamber is connected by a suitable conduit to the inlet of a second, cylindrical shaped chamber having a plurality of wire brushes mounted on a rotor extending through the chamber. An aspiration system connected to the chambers removes hull particles that have been separated from the milo berries. As the milo berries sequentially pass through the chambers, the stones and brushes remove the hulls from the berries.

6 Claims, 7 Drawing Sheets

METHOD AND APPARATUS FOR DEHULLING MILO

This is a divisional of application Ser. No. 08/512,083 filed Aug. 7, 1995, now U.S. Pat. No. 5,713,526.

BACKGROUND

The present invention relates to methods and apparatus for processing grains. More particularly, the invention relates to methods and apparatus for removing hulls from milo or sorghum.

Many different processes have been developed for removing the hull or outer layers from cereal grains such as wheat and rice to make them more processible or palatable.

For example, U.S. Pat. Nos. 4,148,251 and 4,155,295 to Satake disclose rice pearling machines which use a perforated cylindrical chamber and a friction roller to polish rice. U.S. Pat. No. 4,522,837 to Meinardus discloses a similar device having a unique rotor structure which is used to remove bran from rice and other cereal grains. These machines are generally referred to as friction milling apparatus and take advantage of friction created as the rice grains rub on metal surfaces and against each other to remove the bran.

Abrasion machines which use a series of abrasive stones which cooperate with an outer concentrically disposed slotted steel screen are also used to remove bran from grains. The use of such machines is disclosed in U.S. Pat. Nos. 5,082,680 and 5,387,430 to Tkac which use the abrasion machines in series with friction machines to remove bran layers from wheat.

While these apparatus and processes have proved effective in dehulling many types of grains, they have generally proven to be ineffective by themselves in dehulling milo. Milo has an especially strong hull which is difficult to remove. Some types of milo have high levels of tannins in the hull which impart a bitter taste to the grain. Problems in removing the hull have limited the use of milo as a cereal crop in the United States and many areas of the world.

Accordingly, additional processes have been developed to try and remove the hulls from milo. In one process, the hull is removed by simply breaking the grain and aspirating off the chunks of hull. However, this process has been ineffective in removing all of the hull and tannins. Additionally, this process breaks the milo berries, sometimes into small pieces, which causes waste because the small pieces of berry cannot effectively be separated from the hull.

Another process that has been developed utilizes violent water action to try and remove the hull. While this process appears to work technically, it is economically unfeasible.

Accordingly, it would be a significant advancement in the art to provide a method and apparatus for dehulling milo which was efficient and removed essentially all of the tannins. It would be a further advancement in the art if such a process and apparatus was simple and economical to use. Such a process and apparatus are disclosed and claimed herein.

BRIEF SUMMARY OF THE INVENTION

The present invention provides a unique apparatus and method for dehulling milo berries. In a preferred embodiment, the apparatus comprises a pair of chambers through which the milo berries sequentially pass during processing and an aspiration system for removing the separated hulls.

The first chamber has a slotted, cylindrical shaped horizontal steel screen wall and a plurality of abrasive grinding stones concentrically positioned within the chamber. The milo berries are introduced into one end of said chamber and rotate around the chamber as they pass therethrough. The abrasive grinding stones in conjunction with the slotted steel screen begin the removal process of the hull. The berries exit the first chamber at the distal end and pass through a conduit leading to the second chamber.

The second chamber includes a perforated, horizontally positioned cylindrical shaped wall with a rotor longitudinally positioned therein. The rotor in the second chamber includes a plurality of wire brushes which scour the milo berries passing through the second chamber, removing the remaining portions of the hull.

As the pieces of the hull are removed from the milo berries they are separated from the berries by passing through the slots and perforations in the walls of the first and second chambers respectively. Any large pieces fall to the bottom of the housings which enclose the first and second chambers and are removed for further processing or disposal. Small pieces of hull are removed from the housings with an aspiration system. The air passing through this aspiration system is then filtered to collect the particles of hull for further processing or disposal.

The dehulled milo berries exit from the second chamber and are collected for further processing. These berries are edible and can be used in foods or can be further processed to form other products such as loose fill packaging material.

DETAILED DESCRIPTION OF THE PREFERRED EMBODINIENTS

The present invention provides a unique apparatus and method for removing the hull and other outer layers from milo berries.

Figure 1:
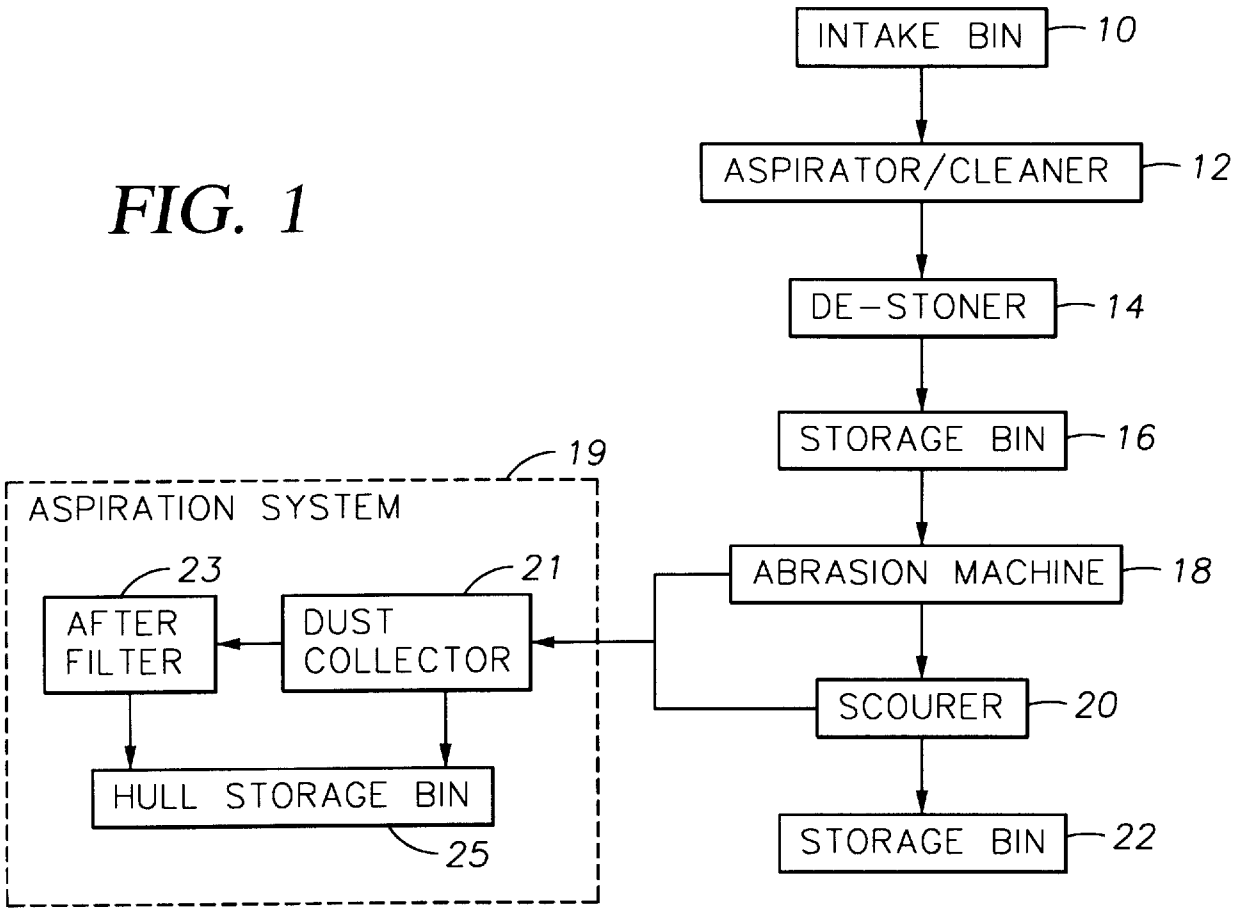
FIG. 1 is a flow chart showing the various steps used in processing the milo berries according to the present invention.

Reference is first made to FIG. 1 which is a flow chart illustrating the various processing steps used to process and dehull milo berries according to the present invention. The milo berries are stored in an intake bin 10 prior to processing. From intake bin 10, the milo berries pass through an aspirator/cleaner 12 which is used to aspirate and clean grain using common grain cleaning equipment. The berries can also be run over sizing equipment to remove small or immature berries. The milo berries then pass through a de-stoner or a gravity separator 14 to remove any unwanted foreign material of high density such as rocks, nails, pieces of wire, etc. The cleaned milo berries are then passed to a storage bin 16.

In order to remove the hull from the milo berries, the berries are first passed through an abrasion machine. Such machines have commonly been used as rice polishing machines. This machine grinds away the exterior of the grain kernels as the berries rotate around a cylindrical shaped chamber. The portions of the hull that are removed form a powder and are generally separated from the berries through slots in the chamber wall and are removed by an aspiration system 19. The partially processed milo berries pass from the abrasion machine through a conduit and into a scourer 20.

The scourer also has a chamber through which the milo berries pass. A rotor positioned within this chamber includes a plurality of wire brushes which scour the milo berries and remove any remaining hull. The hulls are separated from the milo berries by a combination of gravity and by aspiration system 19. The processed milo berries are removed from the scourer and are transported to a storage bin until they are used or packed for shipping.

Aspiration system 19 includes a dust collector 21 and an after filter 23. In the preferred embodiment, aspiration system 19 is a negative air system as described further below. The powdered hull removed from the milo berries is collected in hull storage bin 25 for further processing or disposal.

Figure 2:
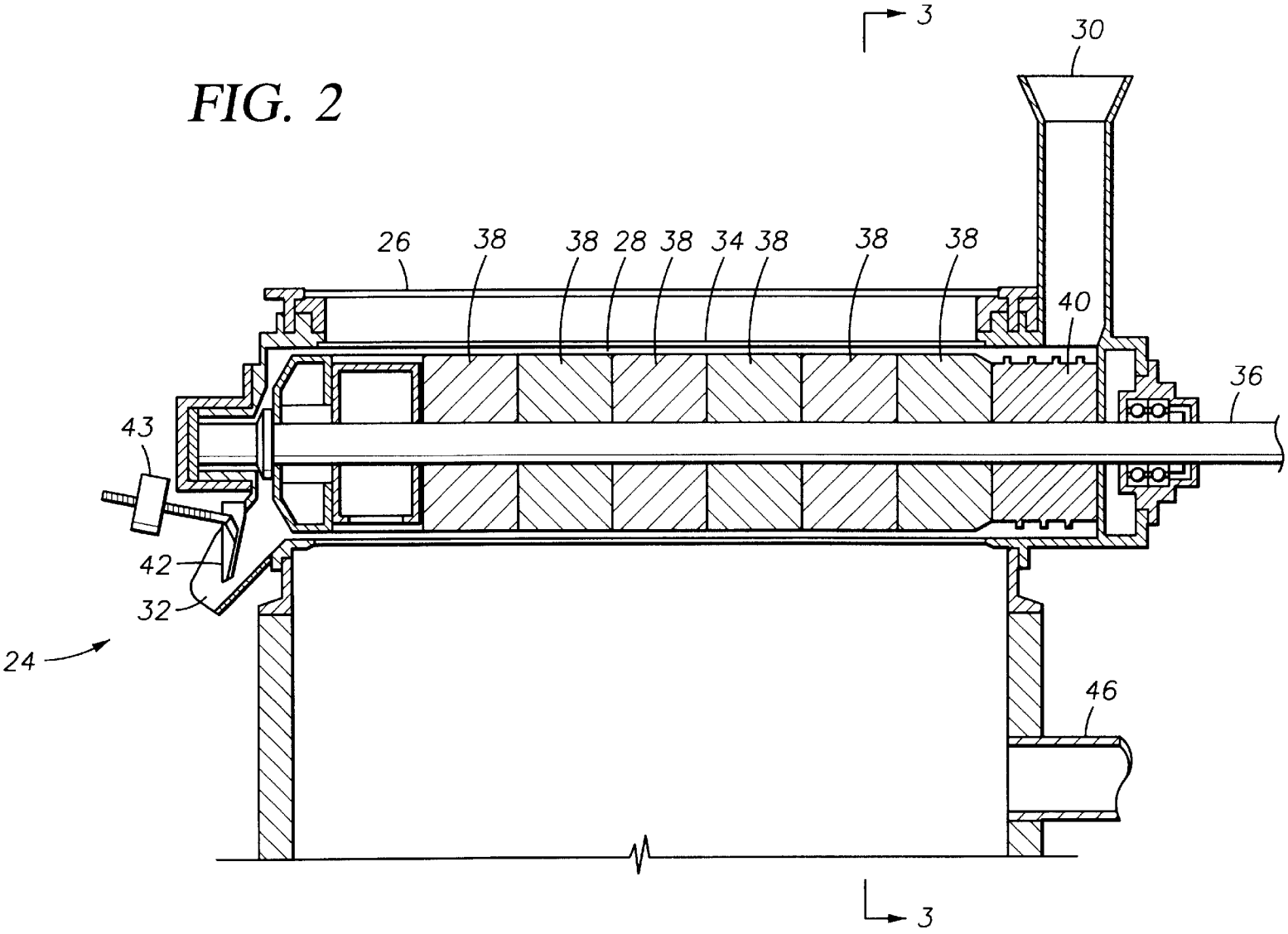
FIG. 2 is a schematic, cross-sectional view of an abrasion machine used in the present invention.
Figure 3:
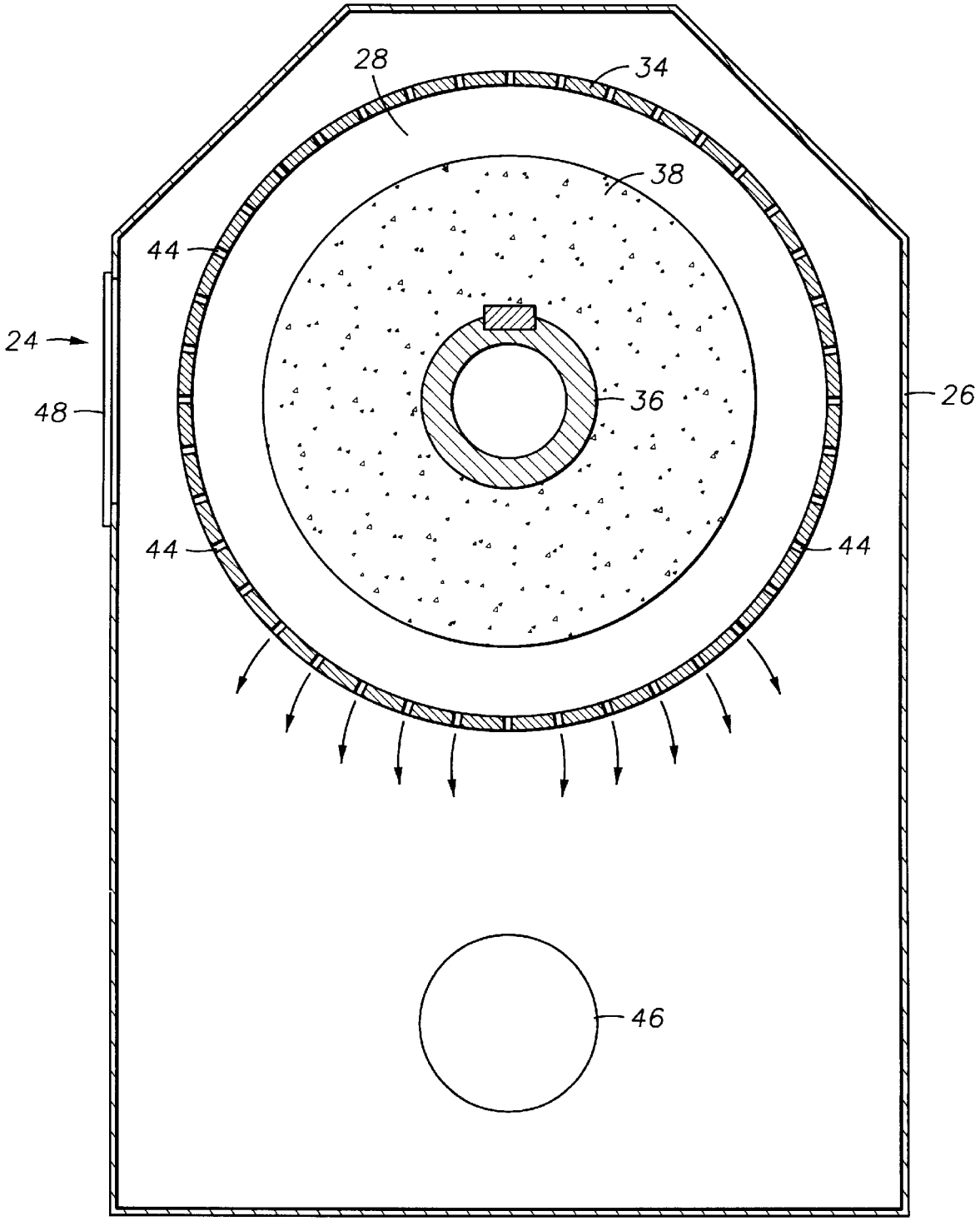
FIG. 3 is a schematic, cross-sectional view of an abrasion machine taken along lines 3—3 of FIG. 2.

Reference is next made to FIGS. 2 and 3 which schematically illustrate an abrasion machine 24 which can be used in the present invention. Machine 24 includes a housing 26 having a cylindrically shaped polishing chamber 28 horizontally positioned therein. Milo berries are introduced through an inlet 30 and are removed through outlet 32 after processing.

Polishing chamber 28 includes a slotted steel screen wall 34. A shaft 36 is longitudinally positioned within polishing chamber 28 and rotates a plurality of grinding stones 38 concentrically positioned within chamber 28. A feed screw 40 urges the milo berries into chamber 28. Shaft 36 is rotated by a suitable motor and drive mechanism (not shown).

A cantilevered damper 42 positioned within outlet 32 regulates the rate at which milo berries pass through polishing chamber 28. By adjusting the weight 43 on damper 42, the residence time of the berries can be increased which results in a greater amount of hull being removed. By properly adjusting the residence time, essentially all of the hull can be removed without causing shrink or unwanted loss of the berry.

Figure 4:
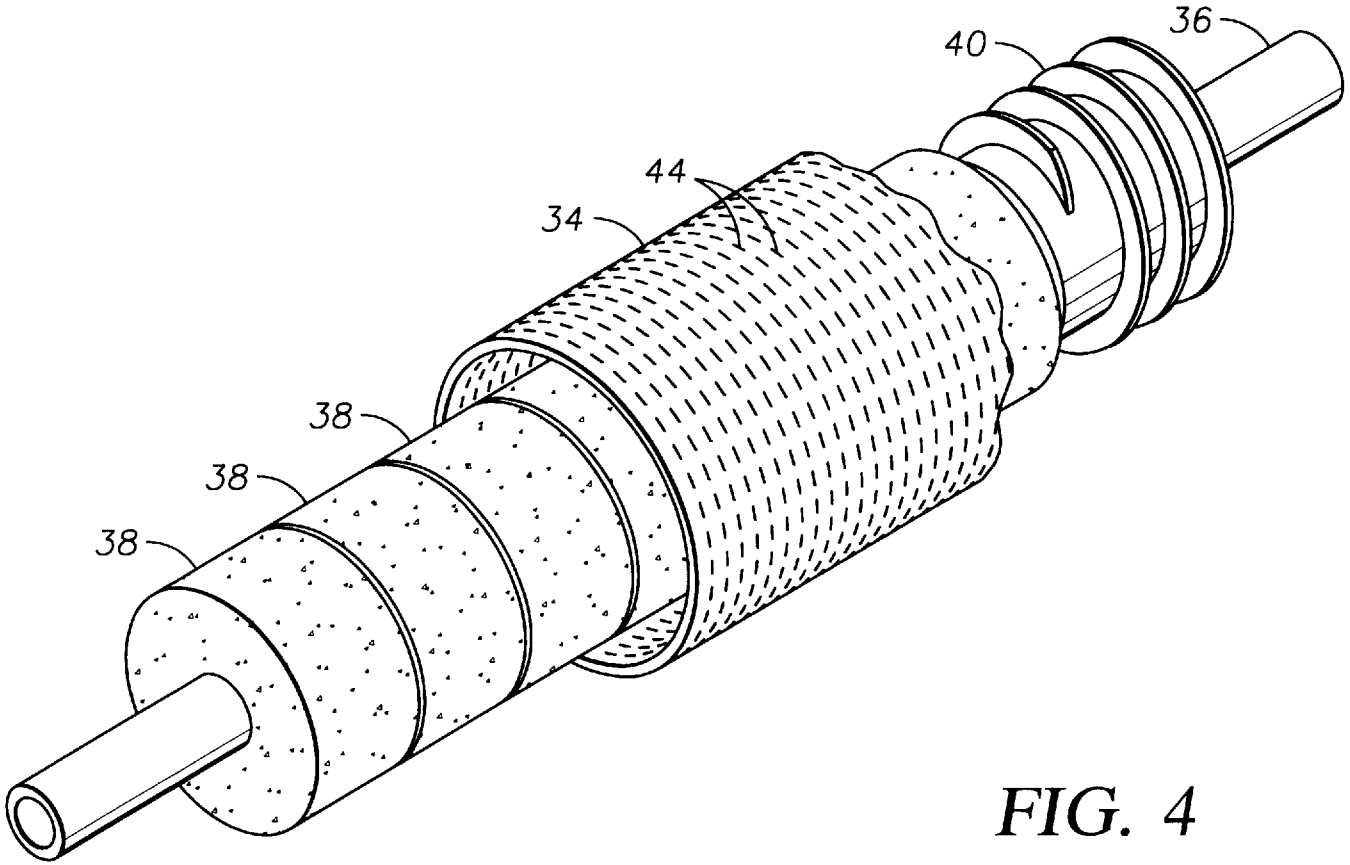
FIG. 4 is a perspective view of the abrasion stones and screen of the abrasion machine of FIG. 2.

Reference is next made to FIG. 4 which illustrates the grinding mechanism in greater detail. A plurality of slotted perforations 44 are formed around wall 34. Perforations 44 are sized such that they do not permit the milo berries to pass through but allow ground up pieces of hull to pass through. In the preferred embodiment, the slots are about three inches long and about 1/16 of an inch wide.

Air flow is used to remove the broken pieces of hull formed during the grinding process. Referring to FIGS. 2 and 3, aspiration system 19, discussed in greater detail below, is connected to housing 26 at outlet 46. System 19 creates a negative air flow through abrasion machine 24 that removes the hull fragments. Air is admitted into housing 26 through a louvered door 48. The air carries the hull pieces passing through the slots 44 in wall 34 to a suitable filtering system where they are collected for further processing or disposal.

In the preferred embodiment, abrasion machine 24 comprises a conventional rice polishing machine. Suitable machines are manufactured by The Satake Corporation and include, for example, the Satake Rice Whitening Machine Model No. IRM30A.

Figure 5:
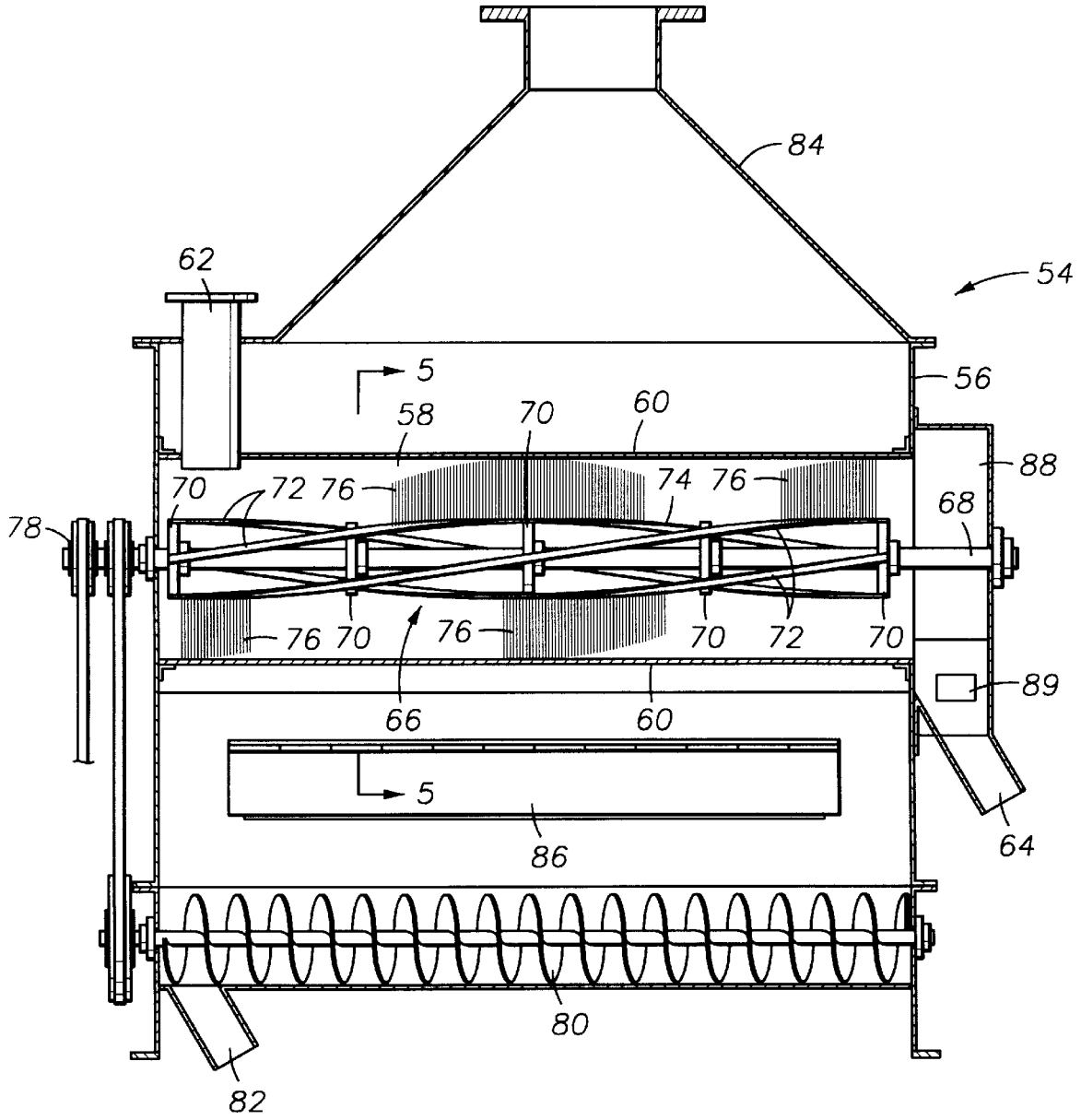
FIG. 5 is a schematic, cross-sectional view of a scouring machine used in the present invention.

Reference is next made to FIG. 5 which is a schematic, cross-sectional view of a scouring machine 54 useful in practicing the present invention. Scouring machine 54 comprises a housing 56 having a generally cylindrical scouring chamber 58 horizontally positioned therein.

Scouring chamber 58 is formed from a perforated wall 60 which, in the preferred embodiment, is formed from stainless steel. An inlet 62 allows entrance of milo berries into a first end of scouring chamber 58 and an outlet 64 in a second end of scouring chamber 58 allows for their removal.

Figure 6:
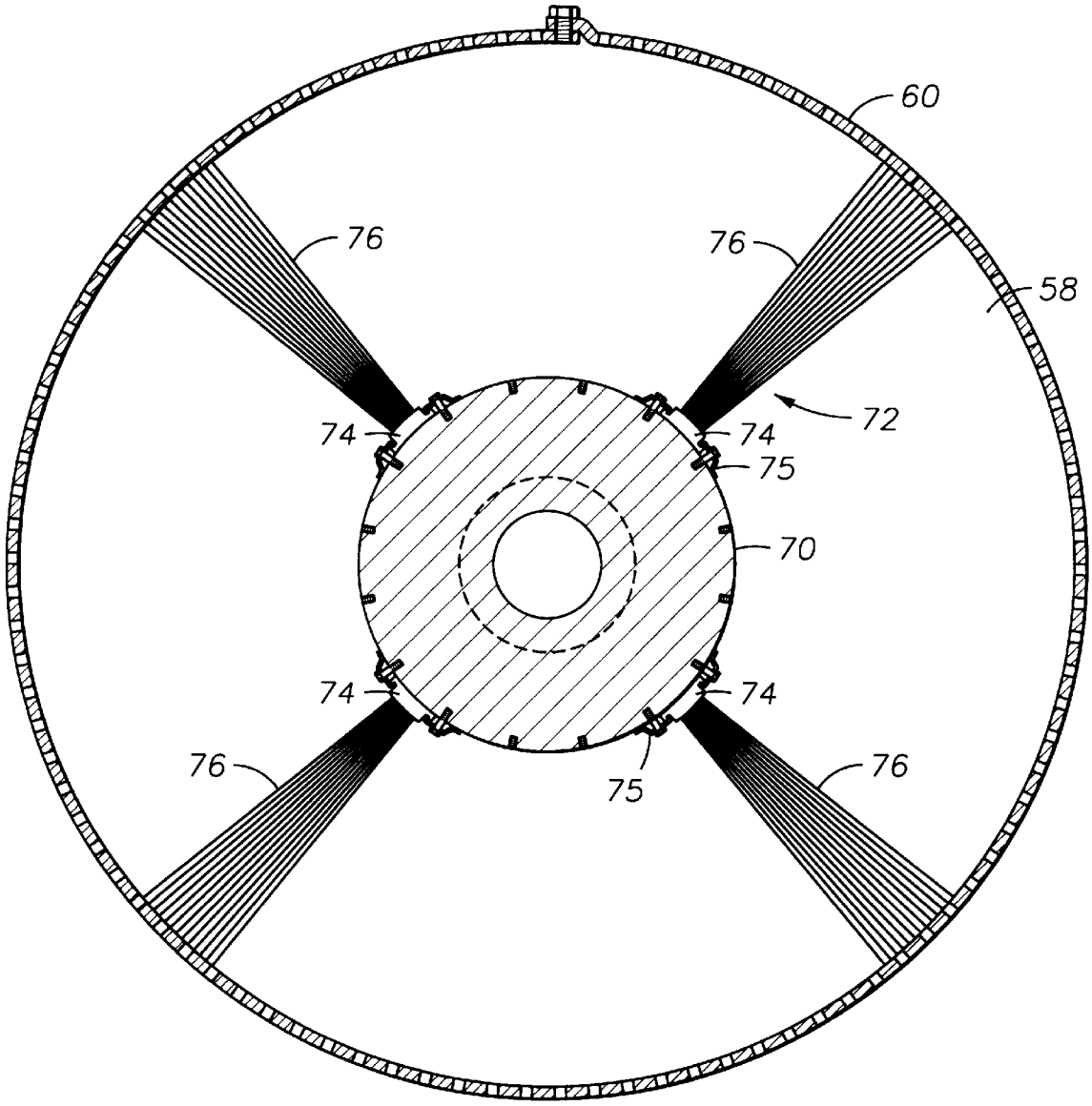
FIG. 6 is a schematic, cross-sectional view of the scouring chamber of a scouring machine taken along lines 6—6 of FIG. 5.

A rotor 66 is longitudinally positioned within scouring chamber 58. Rotor 66 includes an axle 68 and a plurality of hubs 70 spaced along its length. A plurality of wire brushes 72 are connected to hubs 70 and extend to perforated wall 60. (See also FIG. 6.) Wire brushes 70 include a channel 74 which is connected to hubs 70 by clips 75. In the preferred embodiment, brushes 72 are wrapped around rotor 66 in a helical pattern. The helical pattern of wire brushes 72 cause the milo berries to pass through scouring chamber 58 from inlet 62 to outlet 64. One end of wire bristles 76 are secured in channel 74. In FIG. 5, only a portion of the wire bristles are illustrated for each of brushes 72. However, in the preferred embodiment, wire bristles 76 extend along the entire length of channels 74. A drive mechanism 78 is connected to the end of axle 68 to cause rotor 66 to rotate. As the milo berries pass through the chamber, the wire bristles on brushes 72 remove any remaining portions of the hull from the milo berries.

The pieces of hull are separated from the milo berries and pass through the perforations in wall 60. Any heavy pieces fall to the bottom of housing 56 where they are transported by auger 80 to an outlet 82 where they are collected for further processing or disposal. Small pieces of hull passing through wall 60 are removed by aspiration system 19 and are taken to a suitable filtering system where they are collected. An aspiration hood 84 is formed on the top of housing 56 and is connected to aspiration system 19. Dampers 86 are formed in the sides of housing 56 near the bottom to control the amount of air passing through scouring machine 54. A chamber 88 is formed at the outlet end of scouring chamber 58. A damper 89 formed in a wall of chamber 88 introduces air which is pulled back through chamber 58 and into hood 84. This air provides a final wash of the milo berries before they are discharged through outlet 64.

Commercial scouring machines are available in the United States and can be obtained from companies such as Fasco, Inc. in Tampa, Fla.

Figure 7:
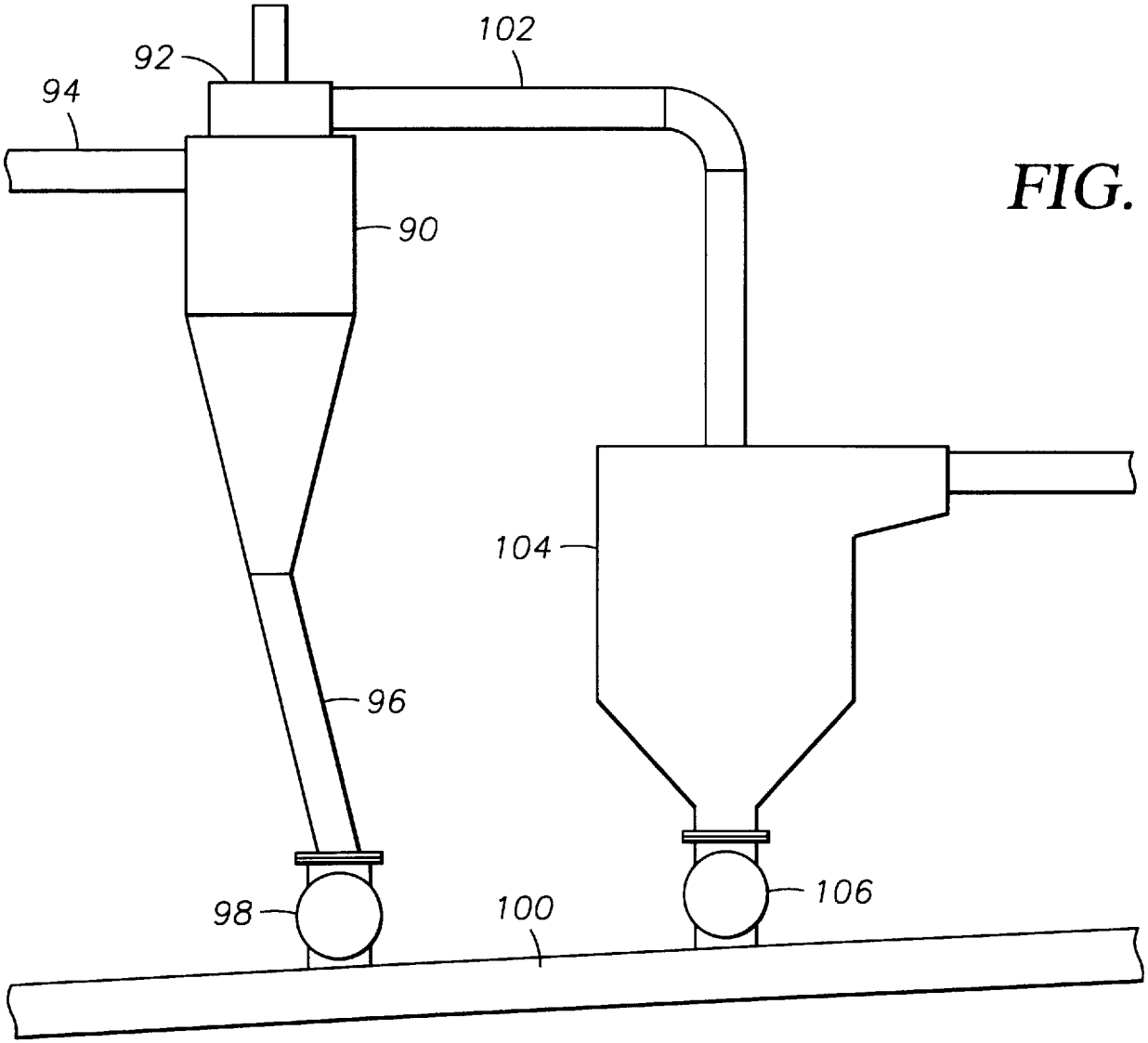
FIG. 7 is a schematic illustration of an aspiration system used in a preferred embodiment of the present invention.

Reference is next made to FIG. 7 which schematically illustrates aspiration system 19 of the present invention. System 19 includes a dust collector 90 which is sometimes referred to as a vacuum drop. A motor and fan 92 are positioned on top of dust collector 90 create the necessary air flow. In the preferred embodiment, the fan has a pull of about 4800 CFM. About 700 CFM are pulled from the scouring machine 54 and the remaining air is pulled from the abrasion machine 24.

Inlet 94 to dust collector 90 is connected by suitable tubing to outlet 46 of abrasion machine 24 and aspiration hood 84 of scouring machine 54. Hull particles in the air flow from machines 24 and 54 are removed by centrifugal force in collector 90. The hull particles drop down through pipe 96 and are removed through an airlock 98 where they are transported by a screw conveyor 100 to a suitable storage bin.

Cleaned air exits collector 90 through pipe 102 where it passes to an after filter 104 which removes any remaining hull particles from the air. In the preferred embodiment, after filler 104 comprises a Torit Downflo II Dust Collector. Hull particles collected in after filter 104 are removed through an airlock 106 and are also transported to a storage bin by screw conveyor 100.

While the invention has been described with respect to the presently preferred embodiments, it will be apparent to those skilled in the art that various changes can be made to the preferred embodiments without departing from the spirit or scope of the invention. Accordingly, the scope of the invention is defined by the appended claims rather than by the foregoing description and all changes or modifications which come within the meaning and range of the claims are to be embraced within their scope.

We claim:

1. A process for dehulling milo berries comprising:

passing milo berries through a first chamber having a slotted, cylindrical shaped wall and a plurality of abrasive grinding stones positioned within said chamber such that said stones remove the hulls from the milo berries introduced into said chamber through an inlet as the berries pass through said chamber and move towards an outlet longitudinally spaced from said inlet; and passing said milo berries through a second chamber having a perforated, cylindrically shaped wall and a rotor longitudinally positioned within said second chamber, said rotor having a plurality of wire brushes secured thereto such that the wire brushes scour said milo berries passing through said second chamber to remove any remaining portions of hull from said berries.

2. A process for dehulling milo berries according to claim 1 further comprising aspirating small pieces of hull passing through the perforations in the walls of said first chamber and said second chamber.

3. A process for dehulling milo berries comprising:

grinding hulls of milo berries with a plurality of abrasive grinding stones which rotate about an axis in a perforated chamber; and aspirating ground pieces of hull from said chamber through perforations in said chamber.

4. A process for dehulling milo berries as defined in claim 3 further comprising scouring said berries in a second perforated chamber with a plurality of wire brushes which rotate about an axis of said second chamber.

5. A process for dehulling milo berries as defined in claim 4 further comprising aspirating pieces of hull from said second chamber through perforations in said second chamber.

6. A process for dehulling milo berries comprising:

grinding hulls of milo berries with a plurality of abrasive grinding stones which rotate about an axis in a first perforated chamber;

aspirating ground pieces of hull from said chamber through perforations in said first chamber;

passing said berries to a second perforated chamber;

scouring said berries in said second perforated chamber with a plurality of wire brushes which rotate about an axis of said second chamber; and aspirating pieces of hull from said second chamber through perforations in said second chamber.

* * * * *